US007475829B2

(12) United States Patent
Hardt et al.

(10) Patent No.: US 7,475,829 B2
(45) Date of Patent: Jan. 13, 2009

(54) NOZZLE CLAMPING NUT FOR INJECTION VALVES AND METHOD FOR PRODUCING SAID NOZZLE CLAMPING NUT

(75) Inventors: Rainer Hardt, Nürnberg (DE); Günter Lewentz, Donaustauf (DE); Dieter Marksteiner, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 468 days.

(21) Appl. No.: 10/894,247

(22) Filed: Jul. 19, 2004

(65) Prior Publication Data

US 2005/0006898 A1 Jan. 13, 2005

Related U.S. Application Data

(63) Continuation of application No. PCT/DE03/00057, filed on Jan. 9, 2003.

(30) Foreign Application Priority Data

Jan. 24, 2002 (DE) ..... 102 02 722

(51) Int. Cl.
*B05B 17/00* (2006.01)

(52) U.S. Cl. ..... 239/1; 239/600; 239/533.2; 285/289.1; 285/328; 251/362

(58) Field of Classification Search ..... 239/600, 239/533.2, 533.3, 1, 5; 251/362; 285/328, 285/289.2, 289.1
See application file for complete search history.

(56) References Cited

U.S. PATENT DOCUMENTS 507,974 A * 10/1893 Crosby ..... 228/154
1,903,315 A * 4/1933 Priebe ..... 285/22
2,389,492 A * 11/1945 Edwards ..... 123/503
3,817,456 A 6/1974 Schlappkohl
3,934,903 A 1/1976 Hofmann et al.
4,202,500 A 5/1980 Keiczek ..... 239/533.3
4,228,960 A 10/1980 Mowbray et al.

(Continued)

FOREIGN PATENT DOCUMENTS

DE 567 230 1/1933 ..... 46/103

(Continued)

OTHER PUBLICATIONS

PCT International Search Report for PCT/DE03/01239, 3 pages.

(Continued)

*Primary Examiner*—Dinh Q Nguyen
(74) *Attorney, Agent, or Firm*—Baker Botts L.L.P.

(57) ABSTRACT

A nozzle clamping nut for an injection valve comprises two sections in the longitudinal direction, having different-sized free inner diameters (D1, D2). A shoulder forms a bearing surface (9) in a transition region between the first and second sections, extending in a circular manner perpendicularly to the longitudinal direction. The nozzle clamping nut has a large bearing surface with low stress concentration. The nozzle clamping nut consists of an inner tube (3) and an outer tube (1) which have different-sized inner diameters (D1, D2), which fit inside each other and which are connected to each other in a fixed manner, and the bearing surface (9) is formed by the annular front surface of the inner tube (3).

19 Claims, 2 Drawing Sheets

U.S. PATENT DOCUMENTS

| | | | | | |
|---|---|---|---|---|---|
| 4,341,351 | A | * | 7/1982 | DeLuca | 239/453 |
| 4,344,575 | A | * | 8/1982 | Seifert | 239/533.5 |
| 4,790,055 | A | | 12/1988 | Raufeisen et al. | |
| 5,033,716 | A | | 7/1991 | Mesenich | |
| 5,205,492 | A | | 4/1993 | Khinchuk | 239/533.4 |
| 5,209,408 | A | * | 5/1993 | Reiter | 239/585.4 |
| 5,697,154 | A | | 12/1997 | Ogihara | |
| 5,746,181 | A | * | 5/1998 | Boecking et al. | 123/470 |
| 5,826,793 | A | | 10/1998 | Askew | 239/124 |
| 5,897,058 | A | | 4/1999 | Coldren et al. | 239/88 |
| 6,142,122 | A | | 11/2000 | Hoppenstedt | |
| 6,182,912 | B1 | | 2/2001 | Müller et al. | 239/585.1 |
| 6,609,667 | B2 | * | 8/2003 | Kiriki et al. | 239/533.3 |
| 6,799,748 | B2 | * | 10/2004 | Enke et al. | 251/362 |
| 6,928,984 | B1 | | 8/2005 | Shamine et al. | |
| 2002/0008159 | A1 | | 1/2002 | Katsura et al. | |

FOREIGN PATENT DOCUMENTS

| | | | |
|---|---|---|---|
| DE | 19900508 | A1 | 7/2000 |
| DE | 199 15 685 | A1 | 10/2000 |
| DE | 19940387 | C1 | 2/2001 |
| DE | 100 17 113 | A1 | 10/2001 |
| DE | 10036137 | A1 | 2/2002 |
| EP | 0799991 | A1 | 3/1997 |
| EP | 0957262 | A2 | 5/1999 |
| EP | 1043496 | | 4/2000 |
| EP | 0637686 | B1 | 7/2004 |
| GB | 423126 | | 1/1935 |
| JP | 04058061 | A | 2/1992 |
| WO | 99/10648 | | 3/1999 |
| WO | 00/60233 | | 10/2000 |
| WO | 02/063159 | | 8/2002 |
| WO | 03/087567 | | 10/2003 |

OTHER PUBLICATIONS

Fuseya, Tsutomu, et al.; "Injector For Fuel Injection In An International Combustion Engine", espacenet.com, Abstract of EP 1043496, 2 pgs.

* cited by examiner

NOZZLE CLAMPING NUT FOR INJECTION VALVES AND METHOD FOR PRODUCING SAID NOZZLE CLAMPING NUT

CROSS REFERENCE TO RELATED APPLICATION

This application is a continuation of copending International Application No. PCT/DE03/00057 filed Jan. 9, 2003 which designates the United States, and claims priority to German application no. 102 02 722.6 filed Jan. 24, 2002.

TECHNICAL FIELD OF THE INVENTION

The present invention relates to a nozzle clamping nut for an injection valve and a method for producing said nozzle clamping nut.

DESCRIPTION OF THE RELATED ART

Such a nozzle clamping nut is known from DE 199 15 685 A1, whereby an injection valve for a common rail injection system of a diesel engine is disclosed. The injection valve comprises a nozzle holder and an injection nozzle fixed to this by means of the nozzle clamping nut. The injection nozzle is held, together with the nozzle holder and the nozzle clamping nut, in a retaining sleeve, with which the injection valve is fixed in the diesel engine. The problem here is that a stress concentration occurs on the annular shoulder in the transition region between the bearing surface and the side wall inside the nozzle clamping nut in the loaded state; this can cause cracks to form in the nozzle clamping nut. Therefore a relatively large radius is provided according to the prior art to reduce the resulting stress concentration in this region. One disadvantage of this large transition radius to reduce the stress concentration is however that the remaining flat bearing surface required to tension the nozzle body of the injection nozzle is reduced. Therefore with the nozzle clamping nuts produced as turned parts according to the prior art, there is a conflict of goals between achieving the required low level of stress concentration and also achieving the required large bearing surface. The same also applies to nozzle clamping nuts produced as extruded parts, in which the bearing surface is turned in a subsequent operation.

One disadvantage of producing the nozzle clamping nut as a turned part is also that the nut is turned from a full piece. This method is time-consuming and the machining volume is relatively high. In the case of a cold-extruded part, a first basic mold is created, which is then turned again in a subsequent operation. The machining volume is thereby significantly lower but only materials that can be made into cold-extruded parts can be used.

SUMMARY OF THE INVENTION

The object of the present invention is to provide a nozzle clamping nut, which achieves a large bearing surface with a low level of stress concentration.

According to the invention this can be achieved with a nozzle clamping nut for an injection valve with two sections in the longitudinal direction comprising different-sized free inner diameters, whereby a shoulder forms a bearing surface in a transition region between the first and second sections, extending in a circular manner perpendicular to the longitudinal direction, and an inner tube and an outer tube, which have different-sized inner diameters, which fit inside each other and which are connected to each other in a fixed manner, wherein the bearing surface is formed by the annular front surface of the inner tube.

The object can also be achieved by a method for producing a nozzle clamping nut for an injection valve, wherein the nozzle clamping nut comprises an outer tube with a larger first free inner diameter and an inner tube with a smaller second free inner diameter, comprising the steps of fitting the outer and inner tubes inside each other and connecting the outer and inner tube to each other in a fixed manner, whereby a bearing surface is formed by the annular front surface of the inner tube inside the nozzle clamping nut.

The outer tube can be formed by a precision-steel tube. The inner tube can be formed by a turned part. A stop shoulder can be configured on the outer circumference of the turned part for the outer tube placed on top. The bearing surface can be configured flat in the contact region with the inner wall of the outer tube. The two tubes can be connected to each other in a fixed manner by adhesive or soldering.

The two-part configuration of the nozzle clamping nut with the fixed connection between a precision-steel tube and a connector, in particular produced as a single turned part, for use as a nozzle clamping nut makes it possible to reduce the stress concentration when subject to an axial force and torque as well as to increase the bearing surface of the nozzle body in a manner that is simple to manufacture.

Also the resulting machining volume is significantly reduced due to the simple structure of the individual components. A high level of dimensional accuracy in relation to form and position tolerances is also ensured due to the use of a precision-steel tube.

The bearing surface of the inner tube is advantageously configured flat in the contact region with the inner wall of the outer tube. This means that the bearing surface of the nozzle clamping nut can be maximized.

According to one preferred embodiment an adhesive-bonded or soldered connection is provided, to minimize possible stress concentrations in contrast to a welded connection - due to the material connection thereby formed.

DETAILED DESCRIPTION OF THE PREFERRED EMBODIMENTS

Four exemplary embodiments of the inventive nozzle clamping nut are described below, shown essentially in longitudinal cross-section diagrams.

Figure 1:
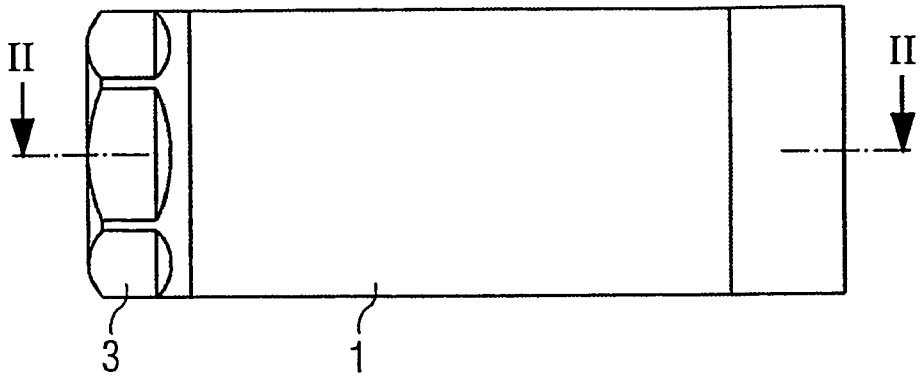
FIG. 1 and 2 show a first exemplary embodiment according to the present invention.
Figure 2:
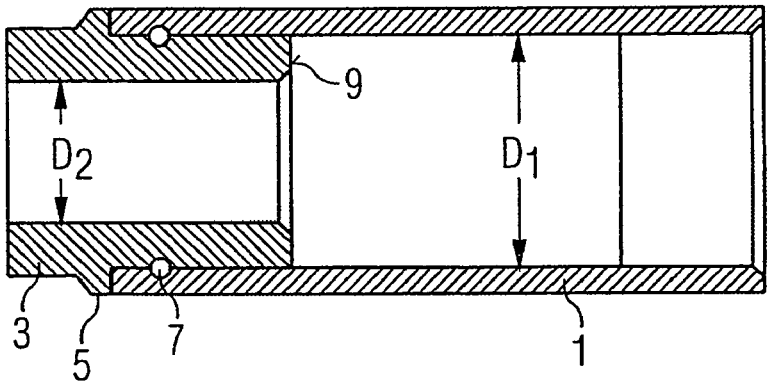

According to the first exemplary embodiment shown in FIGS. 1 and 2, the nozzle clamping nut comprises a precision-steel tube 1 with a first free inner diameter D1 and a tubular turned part 3 with a smaller second free inner diameter D2. The turned part 3 has a bead 5 projecting in an annular manner on its outer wall, which serves as a stop for the steel tube 1. A circumferential groove 7 for a ring of solder is also provided on the outer wall of the turned part 3. To connect the two tubes 1, 3 in a fixed manner to the nozzle clamping nut, the solder is inserted into the annular groove 7 of the turned part 3 in the form of a ring. The two tubes 1, 3 are then placed on top of each other, the nozzle clamping nut is heated and the solder melts and creeps out of the groove 7 into the intermediate space between the turned part 3 and the steel tube 1. The two tubes are thereby advantageously dimensioned for a clearance fit. The bead 5 is disposed so that there is a sufficiently large bearing or support area for the tube 1 on the outer wall of the turned part 3. The front surface disposed inside the steel tube I forms a bearing surface 9 for the nozzle clamping nut. The bearing surface 9 extends perpendicular to the longitudinal direction of the tubes 1, 3. It is configured to be exactly flat and in the boundary region with the inner wall of the steel tube 1 it forms a right angle with this without a transition radius. Therefore the bearing surface is maximized with the geometry predefined by an injection valve to be mounted (not shown) and the resulting stress concentration is minimized. In the transition region between the bearing surface 9 and the inner diameter D2, a small chamfer is provided to facilitate mounting of the injection nozzle. The nozzle clamping device now tensions the injection nozzle against an element of the injection valve (not shown) in the manner known per se from the prior art. The injection nozzle thereby rests on the annular bearing surface 9. As both the first and second inner diameters D1, D2 are determined for the respective integration situation for the injection nozzle, the remaining space is used in an optimum manner for configuration of the bearing surface.

Figure 3:
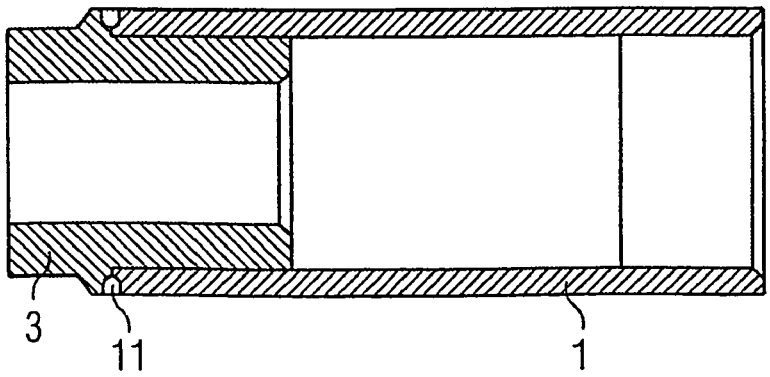
FIG. 3 shows a second exemplary embodiment according to the present invention.

According to the second exemplary embodiment shown in FIG. 3 the two tubes 1, 3 are connected securely to each other by a welded connection or a weld seam 11. In contrast to the first exemplary embodiment, the two tubes comprise a press-fit, which prevents liquid material flowing into unwanted regions of the nozzle clamping nut during the welding process. The welding method used is preferably the WIG (Wolfram Inert Gas) method. This is a known fusion-welding method, whereby a molten bath is produced under inert protective gases.

Figure 4:
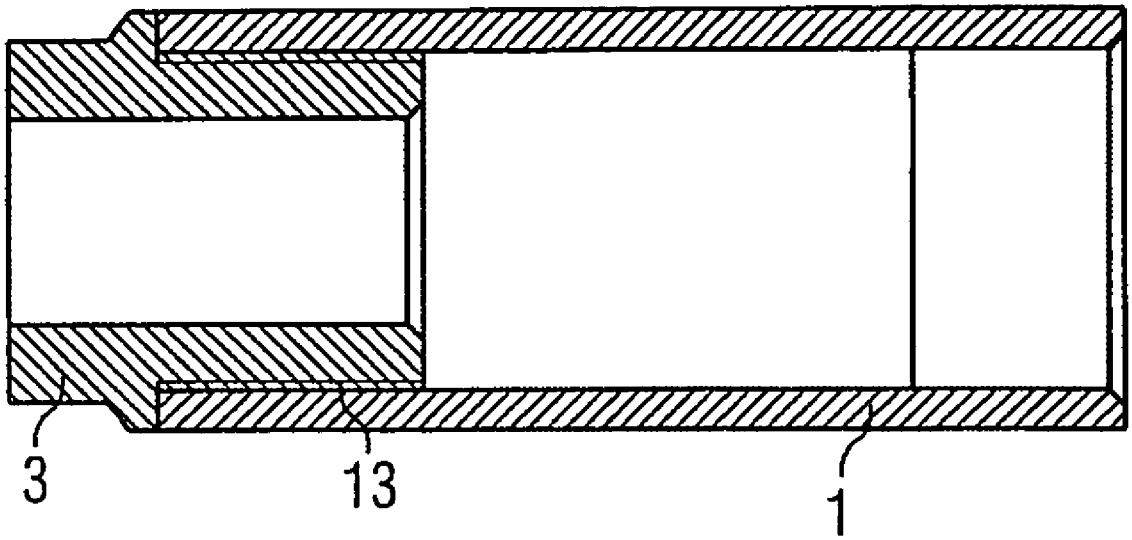
FIG. 4 shows a third exemplary embodiment according to the present invention.

According to the third exemplary embodiment shown in FIG. 4 the two tubes 1, 3 are connected to each other in a fixed manner by means of an adhesive-bonded connection. The adhesive joint 13 selected is thereby as large as possible, with the adhesive used being suitable for the materials used and the deployment requirements relating to the clamping nut.

Figure 5:
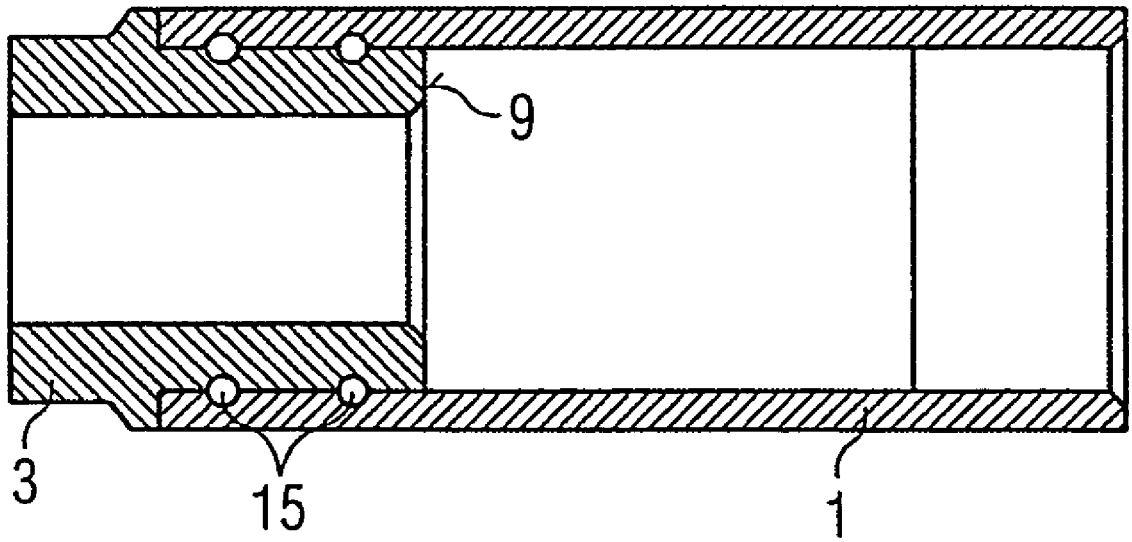
FIG. 5 shows a fourth exemplary embodiment according to the present invention.

According to the fourth exemplary embodiment shown in FIG. 5 the two tubes 1, 3 are connected to each other in a fixed manner by means of at least one laser seam 15. The two laser seams 15 shown in FIG. 5 are thereby at a sufficient distance from the bearing surface 9 to be able to withstand the forces occurring during mounting and during operation.

To summarize, it can be determined that with each of the four exemplary embodiments no stress concentrations occur in the boundary region between the bearing surface 9 of the turned part 3 and the steel tube 1, as a two separate parts are provided according to the invention. Also the surface pressure can be reduced, as the surface available as a result of the bearing surface is increased, even though the overall diameter of the nozzle clamping nut remains the same. In contrast to the prior art the annular corner region in the transition region between the bearing surface 9 and the inner wall of the steel tube 1 can be used as a bearing surface, as a 90° angle is configured according to the invention.

We claim:

1. A method for producing a nozzle clamping nut for an injection valve, wherein the nozzle clamping nut comprises an outer tube with a larger first free inner diameter and an inner tube with a smaller second free inner diameter, comprising the steps of:

fitting the inner tube inside the outer tube; and connecting the outer and inner tubes to each other in a fixed manner, wherein a bearing surface is formed by an annular front surface of the inner tube inside the nozzle clamping nut, wherein the two tubes are connected to each other in a fixed manner by adhesive or soldering.

2. The method according to claim 1, wherein the outer tube is formed by a precision-steel tube.

3. The method according to claim 1, wherein the inner tube is formed by a turned part.

4. The method according to claim 3, wherein a stop shoulder is configured on the outer circumference of the turned part for the outer tube placed on top.

5. The method according to claim 1, wherein the bearing surface is configured flat in the contact region with the inner wall of the outer tube.

6. The method according to claim 1, wherein the connecting the outer and inner tubes to each other in a fixed manner comprises:

providing a circumferential groove in the outer wall of the inner tube;

placing a ring of solder in the circumferential groove;

inserting the inner tube into the outer tube; and heating the tubes, whereby the solder melts and creeps out of the circumferential groove into an intermediate space between the inner and outer tubes.

7. The method according to claim 1, wherein the connecting the outer and inner tubes to each other in a fixed manner comprises:

press-fitting the inner and outer tubes together; and fusion-welding the tubes together in a molten bath under inert protective gases.

8. The method according to claim 1, wherein the connecting the outer and inner tubes to each other in a fixed manner comprises:

applying an adhesive between the inner and outer tubes.

9. The method according to claim 1, wherein the connecting the outer and inner tubes to each other in a fixed manner comprises:

fixing the tubes via a laser seam.

10. A nozzle clamping nut for an injection valve, the nozzle clamping nut comprising:

a first tube and a second tube, wherein the first tube has a first inner diameter and the second tube has a second inner diameter and the first inner diameter is larger than the second inner diameter, wherein the second tube is inserted into the first tube so that the first and second tubes have the same longitudinal axis;

nut faces formed on an exterior of the second tube;

a shoulder in a transition region between the first and second tubes, wherein the shoulder extends in a circular manner perpendicular to the longitudinal axes of the tubes, wherein the shoulder forms a bearing surface in the transition region such that the bearing surface comprises an annular front surface of the second tube; and a fixed connection that connects the first and second tubes comprising adhesive or soldering.

11. The nozzle clamping nut according to claim 10, wherein the first tube is formed by a precision-steel tube.

12. The nozzle clamping nut according to claim 10, wherein the second tube is formed by a turned part.

13. The nozzle clamping nut according to claim 12, wherein a stop shoulder is configured on the outer circumference of the turned part of the second tube, wherein the first tube abuts the stop shoulder.

14. The nozzle clamping nut according to claim 10, wherein the bearing surface is configured flat in a contact region with the inner diameter of the second tube.

15. An injection valve comprising a nozzle clamping nut, wherein the nozzle clamping nut comprises:

a first tube and a second tube, wherein the first tube has a first inner diameter and the second tube has a second inner diameter and the first inner diameter is larger than the second inner diameter, wherein the second tube is inserted into the first tube so that the first and second tubes have the same longitudinal axis;

nut faces formed on an exterior of the second tube;

a shoulder in a transition region between the first and second tubes, wherein the shoulder extends in a circular manner perpendicular to the longitudinal axes of the tubes, wherein the shoulder forms a bearing surface in the transition region such that the bearing surface comprises an annular front surface of the second tube; and a fixed connection that connects the first and second tubes comprising adhesive or soldering.

16. The injection valve according to claim 15, wherein the first tube is formed by a precision-steel tube.

17. The injection valve according to claim 15, wherein the second tube is formed by a turned part.

18. The injection valve according to claim 17, wherein a stop shoulder is configured on the outer circumference of the turned part of the second tube for the first tube placed on top.

19. The injection valve according to claim 15, wherein the bearing surface is configured flat in the a contact region with the inner wall of the first tube.

* * * * *